US009177431B1

(12) United States Patent
String

(10) Patent No.: US 9,177,431 B1
(45) Date of Patent: Nov. 3, 2015

(54) COIN PROCESSING MACHINE

(71) Applicant: GCCM, LLC, Harrisburg, PA (US)

(72) Inventor: Gregory F. String, Mechanicsburg, PA (US)

(73) Assignee: GCCM, LLC, Harrisburg, PA (US)

( * ) Notice: Subject to any disclaimer, the term of this patent is extended or adjusted under 35 U.S.C. 154(b) by 0 days.

(21) Appl. No.: 14/666,399

(22) Filed: Mar. 24, 2015

Related U.S. Application Data

(60) Provisional application No. 61/981,449, filed on Apr. 18, 2014.

(51) Int. Cl.

| | |
|---|---|
| ***G07C 3/00*** | (2006.01) |
| ***G07F 9/02*** | (2006.01) |
| ***G07D 3/12*** | (2006.01) |
| ***G07D 11/00*** | (2006.01) |
| ***G07F 1/04*** | (2006.01) |

(52) U.S. Cl.
CPC ..... *G07D 3/128* (2013.01); *G07D 11/0039* (2013.01); *G07F 1/046* (2013.01)

(58) Field of Classification Search
CPC ..... G07F 1/046; G07F 5/10; G07F 5/12; G07F 5/14; G07F 5/16; G07D 11/0039
USPC ..... 194/200, 229–231, 239, 240, 243; 200/DIG. 3; 453/6, 10, 12, 13
See application file for complete search history.

(56) References Cited

U.S. PATENT DOCUMENTS

| | | | |
|---|---|---|---|
| 7,243,774 | B2 | 7/2007 | String |
| 8,475,242 | B2 | 7/2013 | String |

*Primary Examiner* — Jeffrey Shapiro
(74) *Attorney, Agent, or Firm* — Hooker & Habib, P.C.

(57) ABSTRACT

A coin processing machine includes a coin support plate having a coin support surface defining a coin path extending from an intake location to a coin removal station. Recesses formed in the coin path resist stopping of coins along the coin path. The coin support plate forms part of a normally open control circuit that closes in response to a coin jam along the coin path. A controller in the control circuit responds to the circuit closing by stopping the flow of coins along the coin path.

8 Claims, 7 Drawing Sheets

COIN PROCESSING MACHINE

RELATED APPLICATION

This application claims priority from my U.S. Provisional Patent Application No. 61/981,449 "Coin Processing Machine" filed Apr. 18, 2014, which priority application is incorporated by reference as if fully set forth herein.

FIELD OF THE DISCLOSURE

This disclosure relates to devices that sort or verify coins, and in particular, to devices that drive a singulated stream of coins along a coin path for sorting or verifying.

BACKGROUND OF THE DISCLOSURE

A conventional coin processing machine includes a stationary coin processing plate or rail that supports coins sliding on the plate or rail along a coin path defined on a coin support surface of the plate or rail. A coin slides along the coin path from an initial intake location to a coin removal station where the coin is removed from the support surface. The coin removal station may include, for non-limiting examples, a through-hole that drops coins off the support surface, a guide surface that forces or diverts the coin off the support surface, or a mechanical device that selectively obstructs the coin path and diverts or pushes a coin off the support surface. A coin processing machine may include one coin removal station at the end of the coin path or may include multiple coin removal stations spaced along the coin path. Each station of the multiple removal stations may be dedicated to removing a respective coin denomination off the support surface.

The coins may pass coin sensors, imaging devices, or the like along the coin path to validate and/or determine the diameter and denomination of the coins before reaching the one or more coin removal stations.

A non-limiting example of a known coin processing machine is disclosed in my U.S. Pat. No. 7,243,774, a portion of which is shown in FIG. 8. The coin processing machine includes a conventional processing plate or coin support plate 10, the plate 10 having a flat coin support surface 12. An outer wall 14 extends around a portion of the outer periphery of the support plate 10 and extends above the support plate surface 12. The coin path 16 extends on the support surface 12 adjacent the wall 14 from an upstream intake location represented by the arrow 17 downstream to a coin removal station 18 formed as a through-hole in the plate 10. The coin processing machine is used for coin counting and not coin sorting, and so the coin removal station 18 is the sole coin removal station and removes all the coins from the coin sorting plate.

A sensor set 20 is disposed on the coin path upstream from the coin removal station 18 and determines the size and denomination of coins moving past the sensor set. The radially outermost sensor 20A of the illustrated sensor set 20, for example, is just covered by the outer portion of a US dime moving on the coin path against the wall 14.

Coins are introduced on the coin support surface 12 at the intake location 17 and slide along the coin path 16 to the coin removal station 18. A rotating drive member located above the processing plate has circumferentially spaced, radially elongate, resilient fingers 22 that extend down and press the coins against the support surface 12, the fingers engaging and driving the coins on the coin path 16 (for clarity, only one finger 22 is shown in phantom lines in FIG. 4). The fingers 22 apply a drive torque or a drive force urging the coins along the coin path, but enable centrifugal force to urge the coins against the wall 14 to accurately position the coins on the coin path 16. This feature is conventional and so will not be described in greater detail.

When wet coins are fed onto the coin support surface 12, a wet coin occasionally becomes stationary on the coin support surface 12 and is unable to be driven by the drive member. It is theorized that moisture generates "suction" causing drag between the coin and the coin support surface 12. The drive member is unable to overcome the drag and the coin comes to a stop, creating a jam in the coin processing machine. The drive member continues attempting to move the stationary coin but cannot. The machine must be stopped to clear the coin jam.

The current series of US dime has a diameter of 17.91 mm and a thickness of 1.35 mm and is the thinnest and lightest US coin denomination. Because of this, a wet dime is by far the most likely coin to become stationary on the coin support surface. Being the thinnest coin, the force applied to dimes by the drive member is lower than other coins. It is therefore more difficult for the drive member to apply force sufficient to overcome the drag applied to the dime by moisture.

It would be desirable to reduce the tendency of wet coins to stop on the processing plate. It would also be desirable to automatically stop the drive member when a coin jam occurs on the processing plate of the coin processing machine.

BRIEF SUMMARY OF THE DISCLOSURE

Disclosed is a coin processing machine that includes features to reduce the likelihood and/or the severity of coin jams.

In one aspect, a coin processing plate for a coin processing machine includes a modified coin processing plate that reduces the tendency of wet coins to stop on the processing plate. A number of closely spaced apart depressions are formed on the support surface of the coin processing plate. The size and spacing of the depressions are selected such that the smallest diameter coin intended to be used with the machine completely or partially overlays more than one depression.

The depressions may be formed in the coin path to the first or only coin removal station, or may also be formed in the coin path between adjacent pairs of coin removal stations. The size and spacing of the depressions may differ between adjacent pairs of coin removal stations to reflect the removal of coins at the upstream coin removal station.

The applicant has found that modifying the coin plate to include the described depressions greatly reduces the likelihood of a wet coin stopping on the coin support surface. It is theorized that reducing the surface area of the support surface in contact with the coin decreases the drag on the coin. Because dimes are the most likely US coin to cause jamming, providing depressions covering only the portion of the coin path that will be passed over by dimes was found to be essentially as effective in reducing coin jams as would providing depressions on the entire radial width of the coin path. Thus in an embodiment no depressions are provided along the coin path downstream from a dime removal station. However, in alternative embodiments the depressions are formed on a greater or lesser portion of the coin path as desired.

In another aspect, the coin processing machine includes a control circuit that detects a coin jam and stops the machine if a coin jam is detected. The processing plate of the coin processing machine forms part of the control circuit that detects a coin jam and shuts down the coin processing machine if a coin jam is detected. The control circuit is intended to be used when processing coins capable of conducting electricity and can therefore are capable of forming a conductive portion of an electrical circuit.

An electrical conductor that may be a flat, metal contact plate is placed on the upper surface of the coin support plate. An insulator disposed between the contact plate and the coin support plate prevents the contact plate and the coin support plate from being in direct electrical contact. The contact plate has an outer peripheral edge that extends along and generally parallel to the coin path. Properly aligned coins moving on the coin path do not touch the contact plate.

If a coin jam begins to occur, a coin will remain on the coin support surface but will move off of the coin path and move into contact with the peripheral edge of the contact plate. The contacting coin now electrically connects the contact plate with the coin support plate, closing a normally open control circuit. A PLC or other process controller responds to the closed circuit by shutting off the drive member or otherwise stopping the coins.

In yet a further aspect, a coin processing machine includes both the modified coin processing plate and the control circuit as described above to reduce the likelihood and severity of coin jams.

Other objects and features of the disclosure will become apparent as the description proceeds, especially when taken in conjunction with the accompanying drawing sheets illustrating one or more non-limiting embodiments.

DETAILED DESCRIPTION

Figure 1:
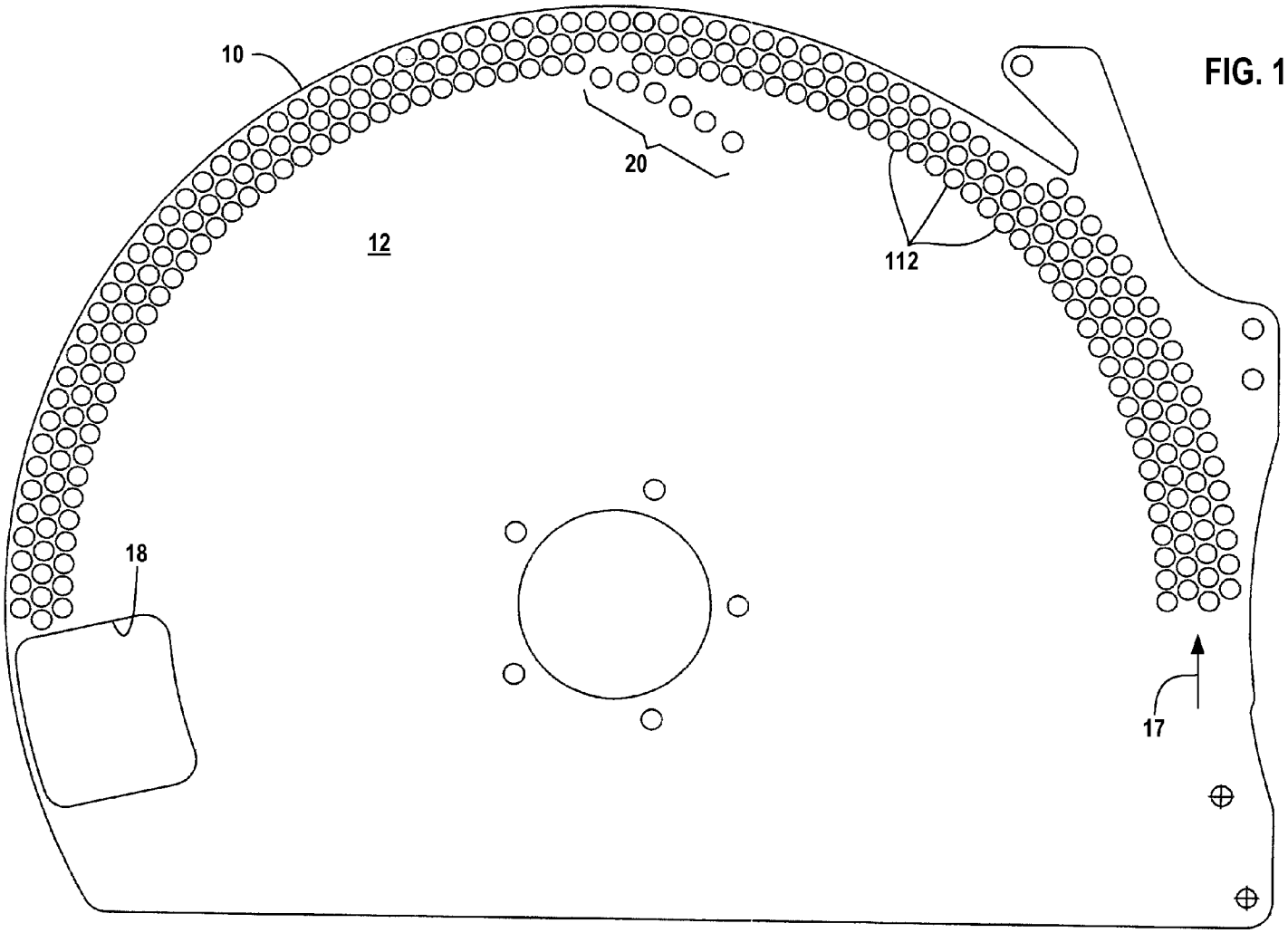
FIG. 1 is a top view of the coin support plate of a coin processing machine having a first type coin removal station and recesses on the coin path extending to the coin removal station.
Figure 8:
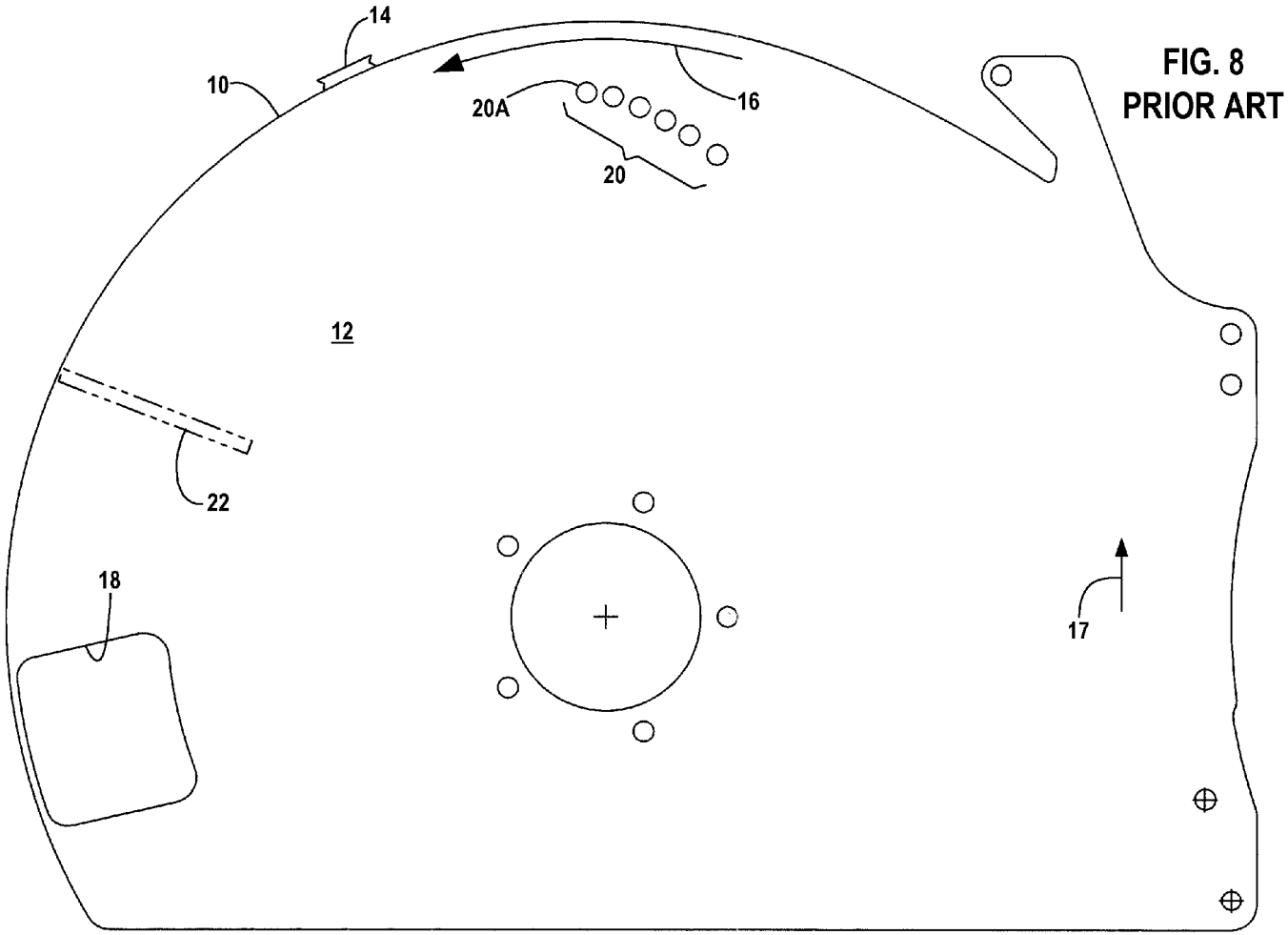
FIG. 8 PRIOR ART
FIG. 8 is a top view of the coin sorting plate of a conventional coin processing machine.

FIG. 1 illustrates a coin processing machine similar to the coin processing machine shown in FIG. 8 but modified in accordance with the present disclosure. Identical components are numbered with the same reference numbers. To simplify the drawing the wall 14 is not shown in FIG. 1.

The coin processing machine shown in FIG. 1 is designed to process US denomination coins, including the penny, nickel, dime, quarter, and dollar coins. The coin processing machine has a coin support plate 10 that includes a number of closely spaced apart depressions 112 formed in the coin support surface 12. The depressions 112 are formed in the radially outer portion of the coin path 16 (see Figure Y) adjacent the wall 14. Coins sliding on the coin support surface 12 along the coin path 16 from the intake location 17 to the coin removal station 18 pass over and are not received into the recesses 112.

In the illustrated embodiment the depressions 112 are disposed only in the portion of the coin path 16 covered by a US dime moving along the coin path against the peripheral wall 14.

Each illustrated depression 112 is about one-quarter inch in diameter, about 0.050 inches deep, and are spaced apart about 0.050 inches from adjacent depressions 112. The size and spacing of the depressions 112 are selected such that a current series US dime could completely or partially overlay more than one depression 112. The size, shape, depth, number, and spacing of the depressions 112 vary in other embodiments based on the size of the coins being sorted, the length of the coin path, the radial width of the coin path to include the depressions, location of coin sensors, and other design considerations.

It has been found that modifying the coin plate 10 to include the depressions 112 greatly reduce the likelihood of a wet coin stopping on the coin support surface 12. It is theorized that reducing the surface area of the support plate in contact with the coin decreases the drag on the coin. Because dimes are most likely to cause jamming, providing depressions 112 covering only the portion of the coin support plate that will be overlayed by dimes was found to be essentially as effective in reducing coin jams as would providing depressions 112 on the entire coin path. However, the depressions 112 could be formed on a greater or lesser portion of the coin path if desired.

In alternative embodiments, the depressions 112 are replaced by narrow, radially spaced arcuate grooves formed on the support surface 12, the grooves in a possible embodiment being concentric with the wall 14 or otherwise parallel with the coin path 16. See FIG. 2. Other groove or depression geometries and spacings could be used to reduce the instantaneous surface area of the support plate in contact with a coin on the coin path.

Figure 3:
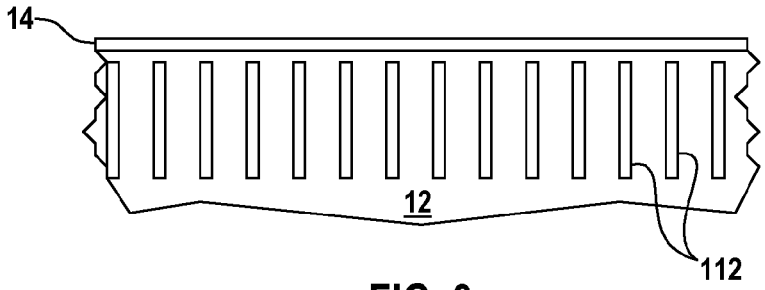

In yet other possible embodiments, the grooves or depressions 112 could be formed as circumferentially spaced, radially-extending grooves. See FIG. 3.

The distance between grooves or depressions 112 may be less than the width of the smallest diameter coin. In other embodiments the distance between grooves or depressions 112 may be greater than the width of the smallest diameter coin—that is, the support surface 12 would support the entire coin for relatively short portions along the coin path 16. These full support portions are preferably too short for the drag on the wet coin to substantially slow sliding of the coin along the coin path.

Although reducing the surface area of the support plate instantaneously supporting a coin reduces the risk of a wet coins stopping on the support surface 12, the risk is not entirely eliminated. When a coin stops along the coin path 16, coins upstream from the stationary coin will often impact the stationary coin and also come to a stop, generating a coin jam. The impacts cause some or all of the coins forming the jam to be located off the coin path radially further away from the wall 14.

Figure 2:
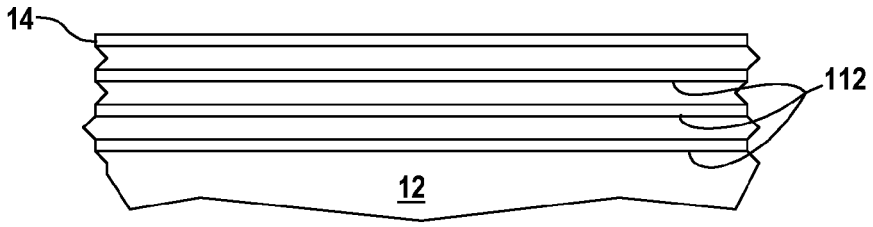
FIGS. 2 and 3 are top views of a portion of the coin support plate shown in FIG. 1 but with alternative recess geometries.
Figure 4:
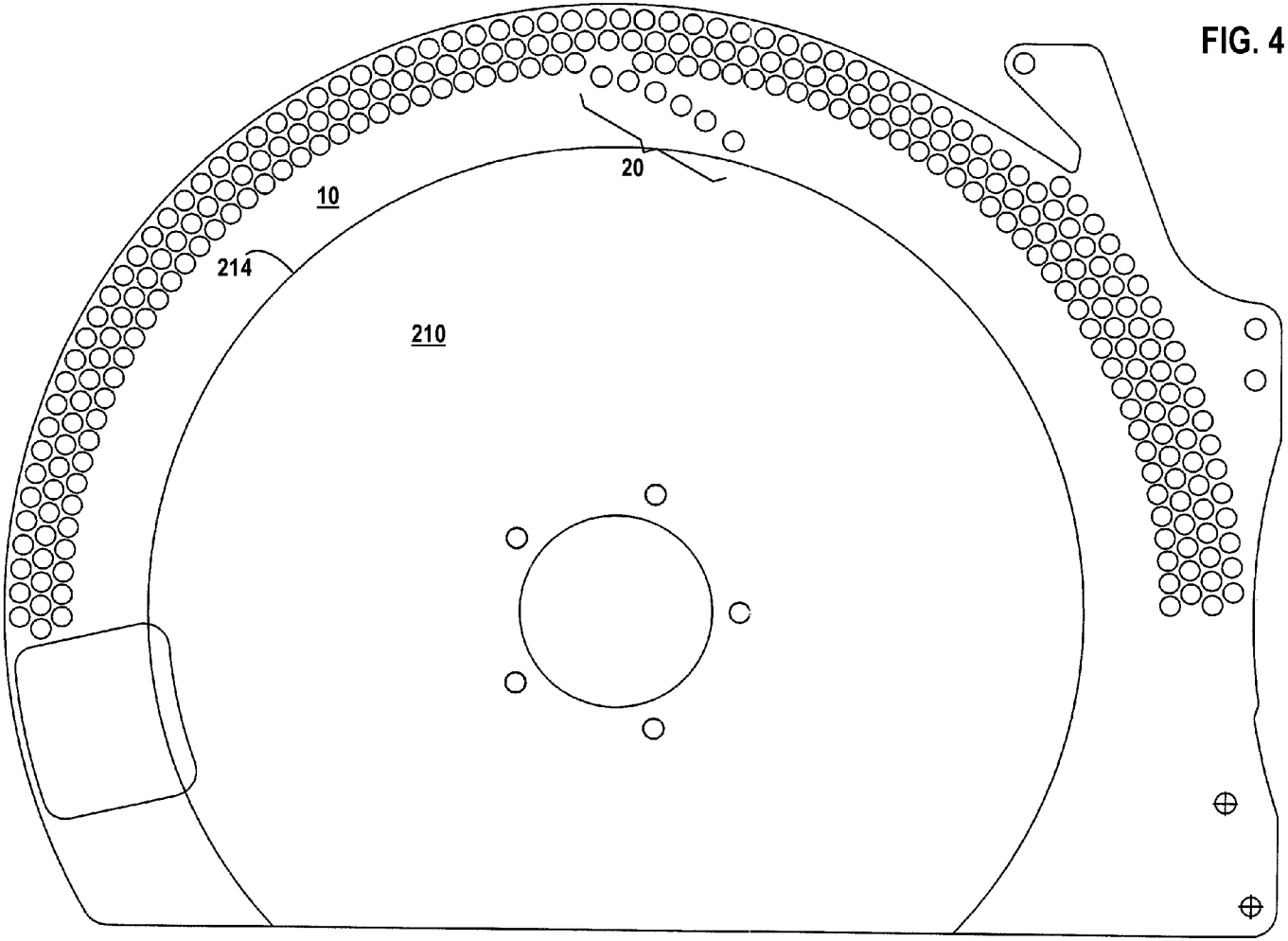
FIG. 4 is a view similar to FIG. 1 but including a component of a jam sensor and control circuit.

FIG. 4 illustrates the coin processing machine shown in FIG. 2 modified to include a circular conductive plate 210 mounted on top of the coin support plate 10. The plate 210 is a relatively thin plate that is made of steel or other suitable electrically conductive material.

The plate 210 is separated from the plate 10 by a layer of insulating material 212 (see FIG. 5) so that the plate 10 and plate 210 are not in direct electrical contact. Any attachment screws or mounting structure attaching the plate 10 to the plate 110 are made of insulating material or are otherwise insulated to not form an electrically conductive path between the plate 210 and the plate 10.

The plate 210 has an outer periphery 214 that is closely spaced away from the inner radial edge of the coin path 16. That is, coins that are moving on the coin support plate 10 on the coin path 16 and against the wall 14 would not contact the plate 210. The largest diameter coin of the coins intended to be processed by the coin processing machine while on the coin path might be spaced only 0.050 inches, or perhaps only 0.10 inches in other embodiments, from the periphery 214.

Figure 5:
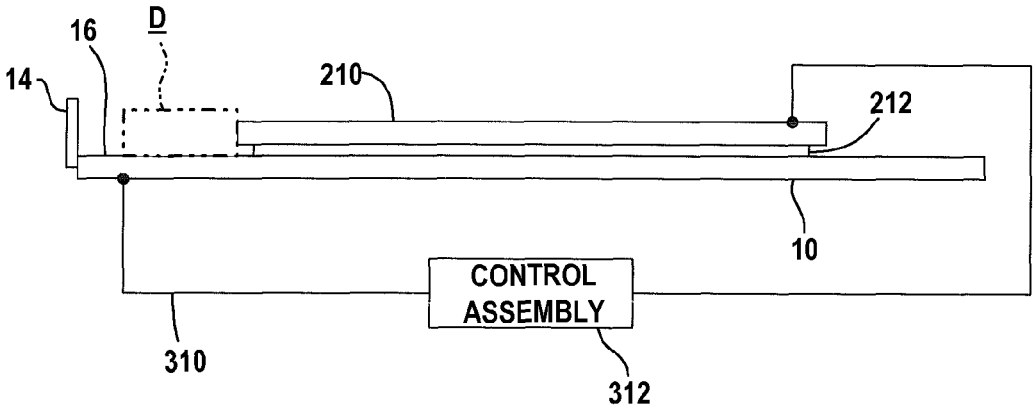
FIG. 5 is a schematic diagram of the jam sensor and control circuit of the coin processing machine shown in FIG. 4.

If a coin jam occurs on the plate 110, a jammed coin such as the coin D shown in phantom in FIG. 5 will move off the coin path and contact the outer periphery of the plate 210. The coin contacting the plate 210 will then form an electrical connection or conductive path between the plate 10 and the plate 210.

As shown schematically in FIG. 5, the coin support plate 110 and the plate 210 form part of a normally open electrical or sensor circuit 310. When the dislocated coin D contacts the plate 210, the coin closes the sensor circuit 310 and actuates a controller or assembly 312. The controller 312 can be an industrial PLC or similar or equivalent process control device known in the industrial process control arts. If a closed circuit is detected indicating a coin jam, the controller 312 stops the drive member and displays a warning message on the user console of the coin processing machine. The controller 312 can also take or initiate whatever other action would be appropriate in the event of a coin jam (actuating a display or alarm, logging an event, or the like).

Figure 6:
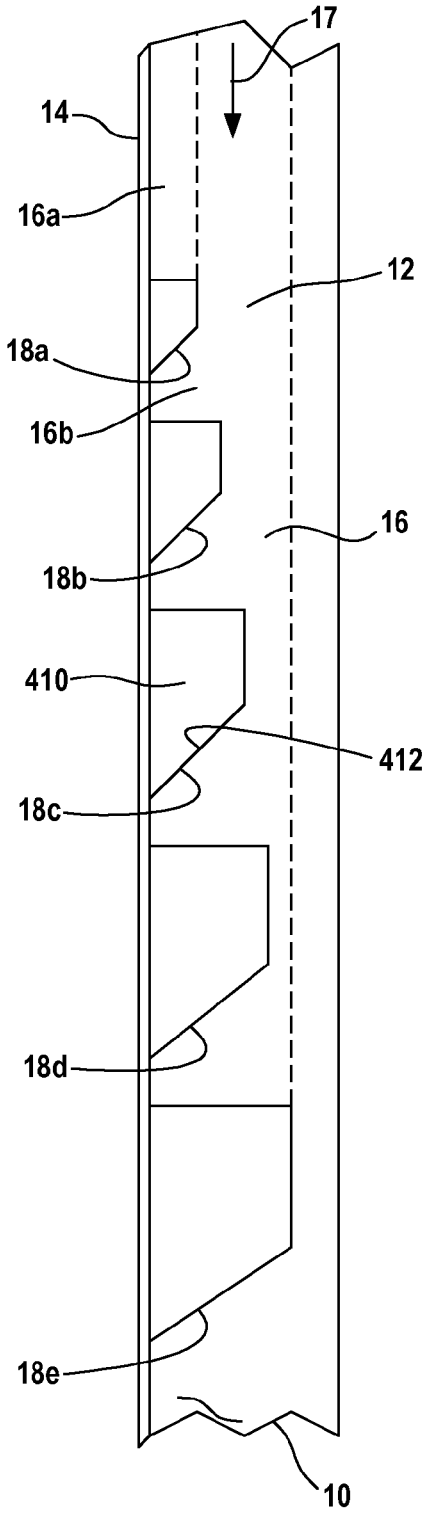
FIG. 6 is a top view of a coin support plate similar to the coin support plate shown in FIG. 1 but having a number of second-type coin removal stations.

FIG. 6 schematically illustrates a coin support plate 10 like that shown in FIG. 2 that defines a coin path 16 (to simplify the drawing the coin path 16 is shown as extending along a straight line). The support plate 10 includes a first coin removal station 18*a* on the coin path 16 that removes dimes from the coin support plate 10 and downstream coin removal stations 18*b*-18*e* that remove pennies, nickels, quarters, and dollars respectively from the coin support plate 10. Each coin removal station 18 includes a recess 410 that receives the coin associated with the coin removal station, the recess 410 defining an abutment wall 412 that guides a coin in the recess 410 off the coin support plate 10. Such coin removal stations 18*a*-18*e* are disclosed in my U.S. Pat. No. 8,475,242 that issued Jul. 2, 2013, which patent is incorporated by reference herein and so will not be described in greater detail. Larger-diameter coins move over the recesses 410 associated with smaller-diameter coin removal stations without being received within them.

The portion 16*a* of the coin path 16 extending from the intake location 17 to the dime removal station 18*a* includes the recesses 112 as shown in FIG. 2 (to simplify the drawing, the recesses are not shown in FIG. 6). The portion 16*b* of the coin path 16 extending downstream from the dime removal station 18*a* does not include any recesses formed in the support surface 10 between adjacent coin removal stations because dimes do not travel on that portion of the coin path.

Figure 7:
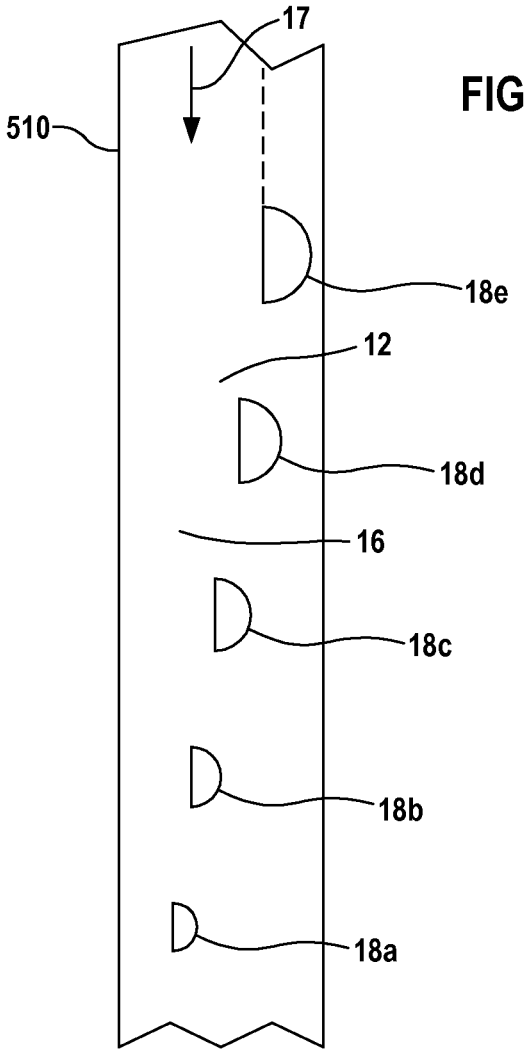
FIG. 7 is a top view of a coin rail having a number of third-type coin removal stations and recesses on the coin path extending to the coin removal stations.

In other embodiments of the coin processing plate 10 shown in FIG. 7, recesses 112 could be formed along the entire coin path 16 from the intake location 17 to the most downstream coin removal station 18, or could be located between some, but not necessarily all, adjacent pairs of coin removal stations 18. The recesses 112 could be located in the portion of the coin path covered by the minimum-diameter coin traveling along that portion of the coin path, could be located in the portion of the coin path covered by the maximum diameter coin traveling along that portion of the coin path, or could be located in the portion of the coin path covered by an intermediate diameter coin traveling along that portion of the coin path.

FIG. 7 schematically illustrates a coin rail 510 having a coin support surface 12 that defines a linear coin path 16 extending from an intake location 17. The coin path 16 extends along the left side of the coin rail 510 as viewed in FIG. 7. Spaced along the coin path 16 are coin removal stations 18*a*, 18*b*, 18*c*, 18*d*, 18*e*. Each coin removal station 18 is a device that is selectively actuated to rotate and present an abutment surface extending into the coin path to remove a coin passing the coin station from the coin rail 510. Selection, timing, and actuation of each coin removal station 18 to remove a coin from the coin rail is conventional and so will not be described in further detail.

Each coin removal station 18 is associated with a respective denomination of coin. In this embodiment the dime removal station 18*a* is the most downstream coin removal station. There are recesses (not shown) like the recesses 112 formed in the coin support surface 12 like those described previously above along the coin path 16 from the intake location 17 to the dime removal station 18*e* to reduce the risk of wet dimes stopping along the coin path 16.

The above embodiments are illustrated in part by a coin processing machine having drive fingers attached to the drive members to drive the coins on the coin support plate. Other ways of driving coins along a coin path are known and can be adapted for use with the drag reduction features and/or the coin jam detection features described above.

While this disclosure includes one or more illustrative embodiments described in detail, it is understood that the one or more embodiments are each capable of modification and that the scope of this disclosure is not limited to the precise details set forth herein but include such modifications that would be obvious to a person of ordinary skill in the relevant art and fall within the purview of the following claims.

What is claimed is:

1. A coin processing machine having features to reduce the likelihood and severity of coin jams, the coin processing machine comprising:

a coin removal station;

a coin support plate comprising a coin support surface on an upper side of the coin support plate, the coin support surface defining a coin path on the coin support surface, the coin path extending from an intake location to the coin removal station, the intake location spaced from the coin removal station along the coin path;

a plurality of recesses formed in the coin support surface and located in the coin path between the intake location and the coin removal station wherein coins sliding along the coin path on the coin support surface pass over some or all of the recesses without leaving the coin path when sliding from the intake location to the coin removal station;

an electrically conductive member overlaying the coin support plate and spaced from the coin support surface, the conductive member normally electrically isolated from the coin support plate, the conductive member spaced from the coin path, the conductive member not overlaying the coin path and comprising an outer periphery, at least a portion of the outer periphery overlaying a portion of the coin support surface spaced from the coin path, the said at least a portion of the outer periphery extending along the coin path;

a control circuit electrically extending from the coin support plate to the conductive member, the control circuit being normally open due to the electrical isolation between the coin support plate and the conductive member, the control circuit comprising a controller responsive to closing of the control circuit by to stop the movement of coins along the coin path.

2. The coin processing machine of claim 1 comprising a drive operable to drive coins along the coin path, the controller responsive to closing of the control circuit to stop operation of the coin drive.

3. The coin processing machine of claim 1 wherein the conductive member is spaced from the coin path by no more than about 0.1 inches.

4. The coin processing machine of claim 1 wherein the conductive member is a plate.

5. A coin processing machine having features to reduce the likelihood and severity of coin jams, the coin processing machine comprising:

a coin removal station;

an electrically conductive coin support plate comprising a coin support surface on an upper side of the coin support plate;

an electrically conductive member spaced from the coin support plate, the conductive member normally electrically isolated from the coin support plate;

the coin support plate defining a coin path on the coin support surface, the coin path extending from an intake location to the coin removal station;

the conductive member overlaying a portion of the coin support surface but not overlaying the coin path, the conductive member having an outer periphery, at least a portion of the outer periphery overlaying a portion of the coin support surface spaced from the coin path, said at least a portion of the outer periphery extending generally parallel with the coin path;

an electrical control circuit extending from the coin support plate to the conductive member, the control circuit being normally open due to the electrical isolation between the coin support plate and the conductive member, the control circuit comprising a controller responsive to closing of the control circuit to stop the movement of coins along the coin path.

6. The coin processing machine of claim 5 comprising a coin drive operable to drive coins along the coin path, the coin drive comprising a plurality of fingers that move adjacent the coin path, the controller responsive to closing of the control circuit to stop operation of the coin drive.

7. The coin processing machine of claim 5 wherein the controller is responsive to closing of the control circuit to generate a visual alarm or an audio alarm.

8. The coin processing machine of claim 5 wherein the controller is a PLC.

* * * * *